United States Patent [19]

Weiss et al.

[11] 4,132,057

[45] Jan. 2, 1979

[54] PROCESS AND APPARATUS FOR PNEUMATIC SEPARATION AND ASPIRATION OF BROKEN THREAD ENDS

[75] Inventors: Helmut Weiss, Göppingen-Bartenbach; Harald Kraft; Wolfgang Igel, both of Ebersbach, Fils, all of Fed. Rep. of Germany

[73] Assignee: Zinser Textilmaschinen GmbH, Ebersbach, Fed. Rep. of Germany

[21] Appl. No.: 728,757

[22] Filed: Oct. 1, 1976

[30] Foreign Application Priority Data

Oct. 1, 1975 [DE] Fed. Rep. of Germany ..... 2543767

[51] Int. Cl.[2] ..... D01H 13/00; D01H 15/00

[52] U.S. Cl. ..... 57/261; 57/279; 57/305; 242/35.6 E

[58] Field of Search ..... 57/34 R, 34.5, 56, 156; 242/35.6 E

[56] References Cited

U.S. PATENT DOCUMENTS

| | | | |
|---|---|---|---|
| 3,236,464 | 2/1966 | Wey | 242/35.6 E X |
| 3,373,552 | 3/1968 | Scherr | 57/56 |
| 3,559,904 | 2/1971 | Raasch | 242/35.6 E |
| 3,813,865 | 6/1974 | Hohloch | 57/34.5 |
| 3,868,813 | 3/1975 | Vignon | 57/34.5 X |

*Primary Examiner*—John Petrakes
*Attorney, Agent, or Firm*—Edwin E. Greigg

[57] ABSTRACT

To effectively separate a broken end of a thread from a thread winding body a process and associated apparatus is herein proposed according to which at least two air streams are directed along the thread winding body and toward a suction air stream, with the air streams being displaced relative to one another in the peripheral direction of the thread winding body and variably inclined relative to the longitudinal axis of the thread winding body.

23 Claims, 2 Drawing Figures

PROCESS AND APPARATUS FOR PNEUMATIC SEPARATION AND ASPIRATION OF BROKEN THREAD ENDS

BACKGROUND OF THE INVENTION

The invention relates to a process for the pneumatic separation and sucking-in of broken thread ends from a thread winding body, and to an apparatus for carrying out the process.

An apparatus for the pneumatic separation and aspiration (sucking-in) of broken thread ends is known, for example, from U.S. Pat. No. 3,868,813. This patent discloses an apparatus having a multiplicity of blow nozzles, disposed on a carrier in the peripheral direction of the thread winding body, which are directed toward the thread winding body at equal angles of inclination in relation to the longitudinal axis of said thread winding body. Above the spindle, bearing the thread winding body, there is a suction bell attached to a source of under pressure during the separation of the thread, which sucks-in the separated end of the thread. With such an apparatus, however, one will not be able relatively frequently to separate the broken end of the thread or suck it into the suction bell.

OBJECTS AND SUMMARY OF THE INVENTION

It is, therefore, a principal object of the invention to provide the state-of-the-art with a process which offers greater probability for the separation of the broken end of the thread and for its being sucked in by the aspirating stream of air.

According to the invention, an air blast is blown out in at least two directions of blowing, displaced in relation to each other in the direction of the thread winding body and inclined variably in relation to the longitudinal axis of the thread winding body. As a result, successful thread separation occurs and is blown into the suction air stream in a much surer fashion than in the case of the known arrangement. In this respect the following should still be noted.

The process of the invention serves especially for the purpose of separating, preferably in spinning or twisting machines, the broken end of the thread on the thread winder after the thread breaks for the purpose of automatic elimination of the thread break, so that the broken end is sucked in by the stream of suction air, seized mechanically and then applied to the pertinent slubbing of the threads that are to be twisted. As a result, the thread break is corrected. The elimination of the thread break is accomplished generally and advantageously by means of a carriage running along the spinning or twisting portions of the pertinent machine, which carries the entire equipment for elimination of thread breaks and also the blowing and suction apparatus, which are required for the separation and sucking-in of the broken threads. The source of compressed air for the air blasts and the source for suction air may be disposed on the carriage, or else they may be stationary, and in the latter case may be connected or brought into connection in any suitable manner with the carriage. The invention however is not limited to spinning and twisting machines, but can also be used with other textile machinery where the broken ends of threads are to be separated pneumatically from the thread developer and blown in in a stream of suction air, for the elimination of thread breaks or some other purpose.

At the same time there is a special problem associated with the separation and sucking in of the broken end of the thread which depends on the height of the thread winding body at the time of the thread break. There may still be a very variably long area of the casing above it, on which the thread winding body is wound. There also exists the danger that the separated end of the thread, whenever it is blown in the direction toward the suction air stream flowing into the suction bell above the spindle and the casing, gets caught and, for example, is wound around the free area of the casing. And to be sure the pneumatic search for the broken end of the thread the spindle must rotate, in order that the entire peripheral area of the thread winding body on which the broken end of the thread will be, can be brought into the active range of the blowing air. As a result of the invention, these difficulties too are eliminated and one will succeed with a high degree of probability in blowing the broken end of the thread into the stream of suction air without it getting caught so that it does not reach the suction air stream. Thus, a thread break in any winding up state of the thread winding body can be eliminated with a high degree of probability.

The blowing directions of the blowing air must naturally be arranged such that the blowing air will convey the broken end of the thread into the effective area of the suction air stream with due consideration of the rebound effect or steering effect of the thread winding body, so that the area of the separated thread can surely be covered by the stream of suction air.

Generally, it will be particularly effective to blow out the entire blowing air in directions which are directed towards the rotational axis of the thread winding body, but it is also possible to provide one or several other blowing arrangements so that not the entire blowing air is blown out in directions pointing to this rotational aixs, but that a part of the blowing air is blown out in other directions, for example, parallel to the rotational axis of the thread winding body. It will be particularly effective to arrange the directions of blowing such that they run in longitudinal central planes of the thread winding body, as a result of which the danger of the separated end of the thread getting caught is avoided particularly reliably.

In order to carry out the process of the invention, an apparatus is provided with which blowing air is blown out in at least two directions, displaced in relation to one another in the peripheral direction of the spindle, and slanted variably in relation to the axis of rotation.

Preferably, several blow nozzles may be provided which effectively may be disposed on a fork, partly encircling the thread winding body at a distance. Generally, it is particularly effective for all blow nozzles to have different blowing directions, whereby it will be particularly effective whenever the obliquities of the blowing directions in relation to the axis of the spindle decrease in the peripheral direction of the thread winding body, starting out from the blowing direction of the largest obliquity, counter to the rotational direction of the spindle, arranged during the separation of the end of the thread. These blowing nozzles may preferably have round cross sections, although other cross sections may also be used. It is also possible to provide slot-nozzles as a blowing nozzle or nozzles, whereby provision may be made, with special advantage, that the slot nozzle has at least two different directions of blowing over the length of its slot, i.e., that the sections of its longitudinal wall determining the blowing directions, intermittently or steadily, in passing have different slantings in relation to the rotational axis of the spindle.

For reasons of construction it will be effective, if blowing air is blown out only opposite a partial area of the periphery of the spindle, which extends preferably over about 180°, so that the carrier having or carrying the blowing nozzle or nozzles, can be transferred without difficulties by horizontal shifting into the intended horizontal operating positions from the carriage carrying the equipment for the elimination of the thread break. At the same time, it has been provided preferably to move the blowing nozzle or nozzles up and down during the separation of the thread, preferably in common with the ring rail of the pertinent machine, in those machines equiped with such a ring rail. In case of a ring rail which carries the spinning and yarn rings, provision may be effectively made for the blowing nozzle or nozzles in their operating position to be at a distance below the ring rail, and thus the blowing air is blown through the pertinent spinning ring or yarn ring. The suction bell (suction mouth) producing the stream of suction air may have its operating position above the casing, effectively at a relatively small distance of, for example, 1–2 cm above the spindle or, in case the casing protrudes upwards beyond the spindle, above the casing.

The invention makes it possible to provide for the advantageous separation of the thread in connection with the forward movement of the spindle, i.e., by having the spindle rotate in the same rotational direction for thread separation as it does for normal operation, so that no reverse drive is needed for the spindle. As a result, it is also possible to advantageously provide for a decrease in the spindle speed by the existing spindle brake, so that a separate apparatus need be provided for this purpose. Possibly reverse drive of the spindle may also be provided for the separation of the thread.

Basically, any number of blow nozzles can be provided. In case of a blow slit, however, it extends over the entire area from which blowing takes place. But generally it is desirable, at least in terms of achieving the smallest possible air consumption, to blow out air blasts at only a few short places. Preferably three blow nozzles with a round cross section may be provided.

The blowing directions can be effectively oriented such that, while the casing is still empty and the position of the blow nozzle is still the lowest possible, the casing on which there may eventually be broken thread ends during rotation on its longitudinal axis, is swept by air blasts. As a result, a broken thread end will be found even when only little thread has been wound on the holder, that is whenever the holder is still empty for the greatest part of its height.

In a preferred further development of the invention, provision is made for blowing air blasts and/or driving the spindle intermittently. Whenever both the spindle drive and the blowing of air blasts takes place intermittently, it may preferably be provided that the intermittent blowing out of the air blasts takes place in equal phases or, in some cases, effectively also in counterphase to the intermittent drive of the spindle. By such measures, the separation of too great a length of thread which may get caught on the machine, for example, on the thread guide or in the draw frame without getting into the suction bell, can be prevented. Also, by such intermittent blowing and/or turning of the spindle, the separation effect for the end of the thread can be improved still.

An advantage is also derived in the case of forward rotation of the spindle as a result of its normal drive. In this case the spindle brake, which is there anyway, will decrease the speed of the spindle to a favorable value with a particularly simple control, since it need stop the spindle only intermittently and then has to release again for a short time.

Intermittent blowing also has the advantage of considerably increasing the separation effect because the impact effect of each starting air blast is greatest in the beginning of the air blast. Also, air consumption will thus be decreased, and this will better counteract thread entanglement.

DESCRIPTION OF THE PREFERRED EMBODIMENTS

Figure 1:
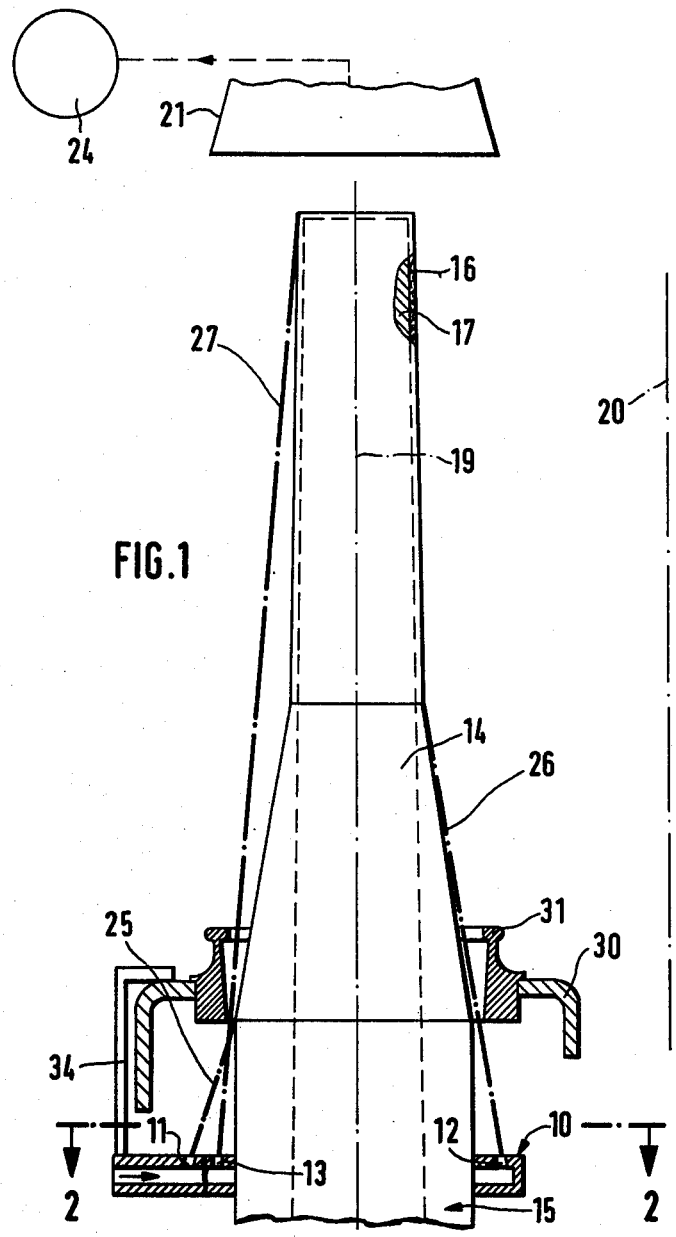
FIG. 1 illustrates a ring rail of a spinning or twisting machine through which a spindle, shown partly in section, extends whereby parts of a pneumatic arrangement according to the invention for the pneumatic separation and sucking in of a broken end of a thread are located near the spindle.
Figure 2:
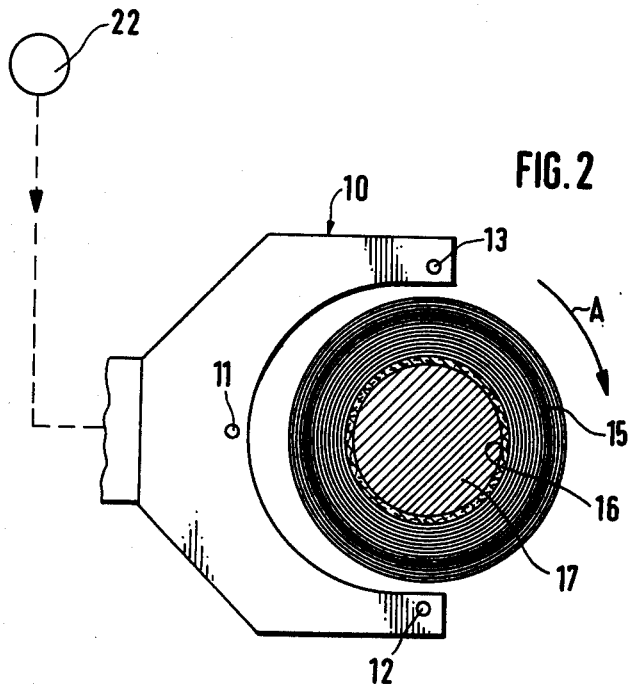
FIG. 2 illustrates a cross-sectional view taken along the line 2—2 of FIG. 1.

A cradle member 10 can be seen in FIG. 2 in top view, which has three blow nozzles 11, 12, 13 connected to a supply of compressed air 22. The nozzles serve for blowing out air blasts for the pneumatic separation of a broken end of a thread which is located on upper, truncated cone-like terminal end area 14 of a thread winding body 15. The thread winding body 15 is wound onto a casing 16 which is stuck onto a customary textile spindle 17, creeled onto a ring spinning or ring twisting machine. This cradle member 10, shown correctly in FIG. 2, has been shown intentionally incorrectly in FIG. 1, in order to show the different blowing directions of the three blow nozzles 11 to 13 in the plane of the paper. Therefore only the blow nozzle 11 of the three blow nozzles 11 to 13 has been drawn in the correct position in FIG. 1, whereas the other two blow nozzles have been shown angularly displaced by 90° in relation to the axis of rotation of the spindle 17, as compared to their real angular positions. In reality therefore, the two blow nozzles 12, 13 in case of a correct presentation in FIG. 1, are located in a plane passing through the axis of rotation 19 of the spindle 17, standing perpendicularly to the plane of the paper, as can be seen from FIG. 2.

The slopes of the blowing directions of the three blow nozzles 11 to 13, always displaced in the peripheral direction of the spindle 17 by 90°, are alway different in relation to the axis of rotation 19 of the spindle 17, but are always directed to the axis of rotation 19 of the spindle 17.

The machine frame of the spinning or twisting machine is indicated by a dash-dot vertical line 20 in FIG. 1. The blow nozzle 11 has the greatest slope in relation to the axis of rotation 19 of the spindle 17, and in relation to the spindle 17 is located diametrically opposite the vertical line 20, and thus opposite the side of the spindle 17 facing away from the longitudinal middle of the machine, i.e., on the control side of this thread winding position having the spindle 17. This is particularly effective because a lateral blowing away of the pneumatically separated thread will be best avoided.

The spindle 17 is driven advantageously during the pneumatic thread separation in the direction of arrow A, whereby this rotational direction may advantageously also correspond to its normal direction of rotation during operation so that this spindle can be slowed down intermittently for the separation of the thread by its spindle brake (not shown). In that case, it will be particularly advantageous to provide that the blow nozzle 12, with the second largest slope in relation to the spindle axis 19, has the greatest slope in a peripheral direction to the rotational direction A toward the blow nozzle 11, and that only then will the blow nozzle 13 come with the least slope in relation to the rotational axis of the spindle, as shown in FIG. 2. The different slopes of the blow nozzles 11 to 13, in relation to the rotational axis of the spindle 17, will bring about the transportation of the separated end of a thread to a suction bell 21. The suction bell 21 is connected with a vacuum supply 24 in such a way that the first air blast jet 25 is sloped the most, then the air blast jet 26 is sloped the second most, and finally the air blast jet 27 is sloped the least to carry the transportation of the separated thread to the suck-in area of the suction bell 21. This arrangement is particularly advantageous for an optimally secure (safe) transfer of the broken thread to the suction bell 21.

Intermittent drive of the spindle 17 and intermittent blowing will serve to insure that large lengths of thread are quickly separated from the thread winding body 15, which otherwise could produce the danger that the separated thread could get caught somewhere and thus would not get into the suction bell.

The preferredly provided intermittent blowing out of the air blast which advantageously may take place in equal phase or, in some cases from time to time in counter phase, with the intermittent drive of the spindle 17, improves the separation effect and the sure blowing of the separated thread to the action area of the suction bell 21.

In this preferred embodiment, the cradle 10 is below the ring rail 30 of the pertinent side of the machine and is moved along with the ring rail 30, for example, by means of a driver 34 resting on the ring rail. With this arrangement it is preferably provided that the blowing out of the air blast is always started whenever the ring rail 30 begins an upward stroke. Generally, the broken thread end will then already be separated pneumatically at the first upward stroke of the ring rail 30, and will be blown into the effective range of the suction bell 21.

In this preferred embodiment the following slopes of the blow directions 25 to 27 of the blow nozzles 11 to 13 in relation to the spindle axis 19 have been provided: 18° for blow nozzle 11, 10° for blow nozzle 12 and 5° for blow nozzle 13.

The spinning and twisting ring 31 inserted in the ring rail 30, and thus the ring rail 30, in the embodiment illustrated in FIG. 1, are already on their upward stroke and the 18° blow angle of the blow nozzle 11 has the effect of the blow direction 25 striking the thread winding body 15 at an acute angle, and in a sure manner effectively both in its cylindrical lower area as well as in the truncated cone-like area 14. In this case, the latter angle of impact is naturally considerably smaller than the angle of impact in the cylindrical area. The 10° blow angle of the blow nozzle 12 corresponds effectively to about half the opening angle of truncated cone-like area 14, so that the blow direction 26 runs parallel to the truncated cone-like area of the thread winding body 15. The blow angle of 5° of the blow nozzle 13 causes this blow direction 27 to bring about an intensive jet of air along the empty area of the casing 16, projecting above the thread winding body 15 for the elimination of thread breaks. This intensive jet of air is brought about especially when the winding up of the thread winding body 15 onto the casing 16 has just been started, as when the cradle 10 and the ring rail 30 are still considerably below the position shown.

These blow nozzles 11 to 13 bring about a sure separation of the broken end of the thread and the feeding of the broken thread to the suction bell 21 independently of the built-up state of the winding up thread winding body 15. This winding build-up progresses slowly from below upwards until the casing 16 is filled.

Furthermore, the two blow nozzles 12 and 13 with the small slopes in relation to the rotational axis of the spindle are at such small distances from the cylindrical area of the thread winding body 15, for example, 2 to 3 mm, that the blow directions 26, 27 pass through the ring 31 and do not strike the underside of the ring 31. The blow direction 25 of the 18° blow nozzle 11 is directed into the ring 31, whereby however the distance of this blow nozzle 11 from the rotational axis of the spindle 19 is greater than that of the other two blow nozzles 12, 13, which is effective because of the larger blowing angle.

The invention insures even air flow over the entire height of the thread winding body 15 and of the casing 16 upwards of at least the spot from which the broken end of the thread could be located. This area begins on or below the lower end of the truncated cone-like thread winding area 14. At the same time, one must take into consideration that the blowing directions 25 to 27 correspond only to the geometric longitudinal axes of the blow nozzles 11 to 13, and air blasts jets broaden out after leaving their respective blast nozzles.

As can be seen, furthermore, the blowing out of the air blast streams takes place such that the air blast always flows directly, or in consideration of the steering effect of the thread winding body 15 and casing 16, always in the direction toward the suction bell 21 and transports the separated end of the thread safely to the suction bell 21. The holder 34 of the cradle 10 is located on a customary carriage, travelling along the spinning and twisting places, which carries the equipment for servicing of thread breaks and, since such carriages and their equipment are well known to experts, they need no further explanation here.

It is self evident that the invention can also be used in textile machines of different kinds.

What is claimed is:

1. A process for the pneumatic separation and sucking-in of a broken end of a thread from the truncated cone-shaped upper area of a thread winding body, comprising the steps of:

(a) directing a stream of suction air to a suction source located in proximate relationship to the thread winding body; and (b) directing at least two air streams from a horizontally movable cradle member in a direction along the thread winding body and toward the suction air stream, wherein the at least two air streams are displaced relative to one another in the peripheral direction of the thread winding body and variably inclined relative to the longitudinal axis of the thread winding body.

2. In an apparatus for the pneumatic separation and sucking-in of a broken end of a thread from the truncated cone-shaped upper area of a thread winding body, comprising:

a textile machine spindle defining an axis of rotation; a casing stuck onto the spindle; and a suction producing device located above the spindle, the improvement comprising horizontally movable cradle member means from which at least two air streams are directed along the thread winding body and toward the suction producing device, wherein the at least two air streams have a different slope relative to the spindle axis of rotation and are mutually displaced in the peripheral direction of the spindle.

3. The apparatus as defined in claim 2, wherein the cradle member partially encircles the thread winding body at a distance in which at least one blow nozzle is defined.

4. The apparatus as defined in claim 3, wherein a plurality of blow nozzles are defined in said cradle member.

5. The apparatus as defined in claim 4, wherein at least two blow nozzles are defined in said cradle member of variably sloped blowing directions, and wherein the at least two blow nozzles have variably large distances from the axis of rotation of the spindle.

6. The apparatus as defined in claim 5, wherein the blow nozzle with the greatest slope relative to the axis of rotation of the spindle is at a greater distance from the axis of rotation of the spindle than at least one other blow nozzle.

7. The apparatus as defined in claim 5, wherein the blow nozzle with the greatest slope relative to the axis of rotation of the spindle is located opposite to the side of the spindle facing away from the longitudinal middle of the textile machine with which the apparatus is used.

8. The apparatus as defined in claim 4, wherein three blow nozzles are defined in said cradle member.

9. The apparatus as defined in claim 8, wherein the three blow nozzles are mutually angularly displaced by approximately 90°.

10. The apparatus as defined in claim 8, wherein the slopes of the three blow nozzles toward the axis of rotation of the spindle are 18°, 10° and 5°, respectively.

11. The apparatus as defined in claim 4, wherein all the blow nozzles are variably sloped toward the rotational axis of the spindle.

12. The apparatus as defined in claim 11, wherein the slopes of each blow nozzle starting with the blow nozzle having the largest slope decrease in the peripheral direction of the thread winding body counter to the rotational direction of the spindle arranged during separation of the end of the thread.

13. The apparatus as defined in claim 3, wherein the blow nozzles have round cross sections.

14. The apparatus as defined in claim 3, wherein at least one blow nozzle is a slot nozzle.

15. The apparatus as defined in claim 14, wherein the at least one slot nozzle has different blowing directions over its length.

16. The apparatus as defined in claim 2, wherein the directions of the air streams coincide with longitudinal middle planes of the thread winding body.

17. The apparatus as defined in claim 2, wherein the flow of air in said at least two air streams and the spindle drive occurs intermittently.

18. The apparatus as defined in claim 17, wherein the intermittent flow of air takes place in phase to the intermittent drive of the spindle.

19. The apparatus as defined in claim 17, wherein the intermittent flow of air takes place in counter phase to the intermittent drive of the spindle.

20. The apparatus as defined in claim 2, wherein the flow of air in said at least two air streams occurs intermittently.

21. The apparatus as defined in claim 2, wherein the spindle drive occurs intermittently.

22. The apparatus as defined in claim 2, wherein the rotational direction of the spindle, during separation of a thread, coincides with the rotational direction during standard operation.

23. The apparatus as defined in claim 2, wherein the means from which at least two air streams are directed along the thread winding body is movable parallel to the rotational axis of the spindle.

* * * * *